US006079965A

United States Patent [19]

Delmotte

[11] Patent Number: 6,079,965

[45] Date of Patent: Jun. 27, 2000

[54] CYLINDER, FOR A ROLLING PISTON COMPRESSOR

[75] Inventor: Scott J. Delmotte, Tioga, Pa.

[73] Assignee: Dresser-Rand Company, Corning, N.Y.

[21] Appl. No.: 09/024,115

[22] Filed: Jan. 17, 1998

[51] Int. Cl.[7] ..... F01C 1/02

[52] U.S. Cl. ..... 418/63; 418/64; 418/65; 418/66; 418/67; 418/157

[58] Field of Search ..... 418/63, 64, 65, 418/66, 67, 157

[56] References Cited

U.S. PATENT DOCUMENTS 4,790,733 12/1988 Vaccaro ..... 418/63

5,244,366 9/1993 Delmotte ..... 418/63

5,246,356 9/1993 Scarfone ..... 418/63

5,823,755 10/1998 Wilson et al. ..... 418/15

*Primary Examiner*—Thomas Denion

*Assistant Examiner*—Theresa Trieu

*Attorney, Agent, or Firm*—Bernard J. Murphy

[57] ABSTRACT

A slit, spanning a distance across the top of the vane slot in a cylinder for a rolling piston compressor, safely distributes the stress which occurs in the vane slot. The slit opens onto the bore, in the cylinder, which is provided for a rotary shaft and rotary piston, and onto the vane slot.

4 Claims, 1 Drawing Sheet

CYLINDER, FOR A ROLLING PISTON COMPRESSOR

This invention pertains to gas compressors, and in particular to rolling piston compressors which have bodies with cylindrical bores, and a vane slot opening onto the bore to receive a slidable vane and a rolling piston for translating the vane in the slot.

Rolling piston compressors experience severe stress concentrations, at the top of the vane slot, which either cause fractures of the body of the cylinder, or require the discharge pressure of the compressor to be held to some arbitrary, inadequately low value to avoid structural failures of the compressor or cylinder body.

What has been sorely needed, in this technology, is some efficient and inexpensive means for safely distributing the high stress concentrations which occur in the vane slot, at the outer portion thereof, in order that (a) the compressor or cylinder body will not be susceptible of fracture or such failure, and (b) so that the compressor can be configured to deliver higher discharge pressures than would otherwise be possible.

In view of the aforesaid need, it is an object of this invention to set forth a cylinder, for a rolling piston compressor, which meets the long sought requirements. Particularly, it is an object of this invention to disclose a cylinder, for a rolling piston compressor, comprising a body; said body having a cylindrical bore formed therein; a vane slot formed in said body, opening onto said bore; an inlet passageway, formed in said body, in communication with said bore; a discharge passageway, formed in said body, in communication with said bore; and means formed in said body for distributing stress occurring in said vane slot.

Figure 2:
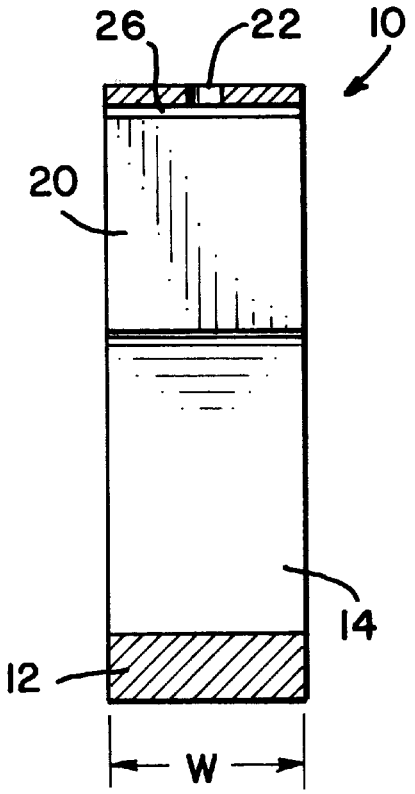
Figure 1:
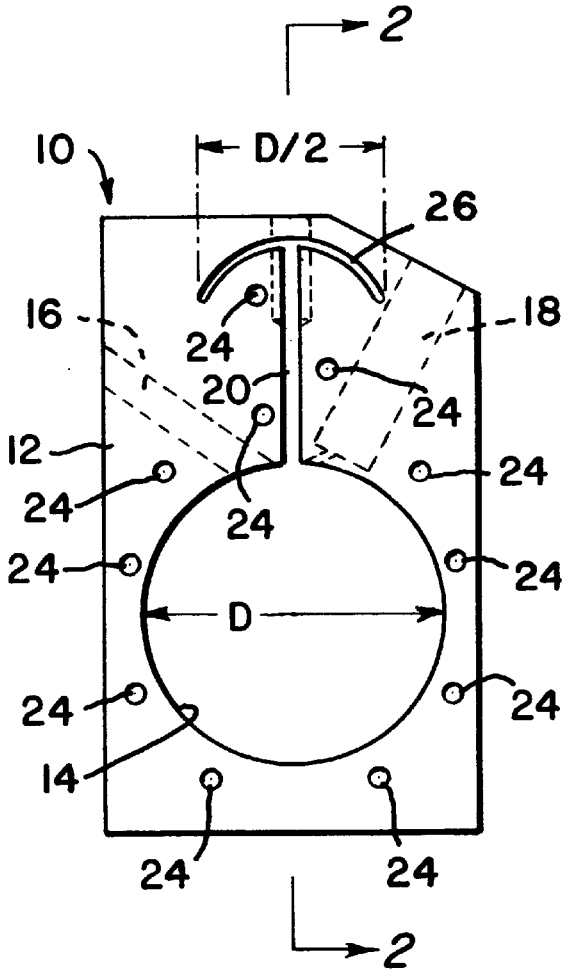

Further objects of this invention, as well as the novel features thereof, will become evident upon reference to the following description, taken in conjunction with the accompanying figures, in which:

FIG. 1 is an end, elevational view, of a cylinder for a rolling piston compressor, according to an embodiment of the invention; and FIG. 2 is a cross-sectional view taken along section 2—2 of FIG. 1.

As shown in the figures, a cylinder 10, for a rolling piston compressor, has a body 12 with a cylindrical bore 14 formed therein. As is conventional for rolling piston compressors, the bore 14 is provided for receiving therein a rotary shaft and a shaft-mounted rotary piston. Also, typically, the body 12 has an inlet passageway 16 and an outlet passageway 18 formed therein, for opening onto the bore 14 to admit gas into, and for discharging pressured gas from the cylinder 10. Additionally, the cylinder has a vertically disposed slot 20 formed therein, the slot 20 also opening onto the bore 14, for slidably receiving a vane. Atop the cylinder 10 is a bore 22 for nesting therein a compression spring and a spring-holding plug, or the like, for biasing the vane against the rotary piston. Finally, the cylinder 10 has a plurality of hardware-receiving holes 24 (shown only on one side of the cylinder 10) for fastening to each side of the cylinder 10 end covers (not shown).

As described thus far, the invention comprises nothing not already known and practiced in the prior art. However, a rolling piston compressor cylinder, as described, is susceptible to inordinately excessive stress concentrations at the top of the vane slot 20. Such stress concentrations can cause fracture of the cylinder, over time, for which the cylinder would have to be discarded. Alternatively, the compressor, in which such a cylinder is employed, would have to be held to relatively low discharge pressures, in order to avoid the occurrence of such aforesaid stress concentrations.

The invention, however, sets forth means for safely distributing stress occurring the vane slot 20. As can be seen in the Figures, a slit 26 is formed in the cylinder, across an outer portion of the vane slot 20. The slit 26 is in communication with the vane slot 20, and extends fully across the with "W" of the cylinder 10. Generally, dimensional considerations would be determined by the ambient circumstances, the discharge pressures desired, the structure of the cylinder 10, and such. However, the slit 26, preferably, would span a distance "D/2" of approximately half the diameter "D" of the bore 14.

A cylinder 10, such as is depicted in the figures, constructed with the slit 26, can provide higher discharge pressures than would otherwise be possible, without any likelihood of the same suffering failure due to stress concentrations in the vane slot 20.

While I have described my invention in connection with a specific embodiment thereof, it is to be clearly understood that this is done only by way of example, and not as a limitation to the scope of the invention, as set forth in the objects thereof, and in the appended claims.

I claim:

1. A cylinder, for a rolling piston compressor, comprising:

a body;

said body having a cylindrical bore formed therein;

a vane slot formed in said body, and opening onto said bore;

an inlet passageway, formed in said body, in communication with said bore;

a discharge passageway formed in said body, in communication with said bore; and means formed in said body for distributing stress occurring in said vane slot; wherein said means comprises a slit which is in communication with said slot;

said bore has a given diameter; and said slit has lateral terminations which bridge a distance of approximately half said diameter.

2. A cylinder, for a rolling piston compressor, according to claim 1, wherein:

said vane slot occupies a given plane; and said means is arranged transverse to said plane.

3. A cylinder, for a rolling piston compressor, according to claim 1, wherein:

said slit is formed across an outer portion of said vane slot.

4. A cylinder, for a rolling piston compressor, according to claim 1, wherein:

said body has a given width; and said slit extends fully across said given width.

* * * * *